US005424030A

United States Patent [19]

Takahashi

[11] Patent Number: 5,424,030

[45] Date of Patent: Jun. 13, 1995

[54] COPPER ALLOY FOR FINE PATTERN LEAD FRAME

[75] Inventor: Hideya Takahashi, Shizuoka, Japan

[73] Assignee: Yamaha Metanix Corporation, Shizuoka, Japan

[21] Appl. No.: 161,727

[22] Filed: Dec. 3, 1993

[30] Foreign Application Priority Data

Dec. 3, 1992 [JP] Japan ..... 4-324427

[51] Int. Cl.[6] ..... C22C 9/05; C22C 9/06

[52] U.S. Cl. ..... 420/473; 420/481; 420/487; 148/433; 148/434; 148/435

[58] Field of Search ..... 420/473, 481, 485, 487; 148/433, 434, 435

[56] References Cited

U.S. PATENT DOCUMENTS 4,657,601 4/1987 Guha ..... 148/12.7 C
4,792,365 12/1988 Matsui et al. ..... 148/12.7 C

FOREIGN PATENT DOCUMENTS 2-145737 6/1990 Japan .
4-99838 3/1992 Japan .
4-53936 8/1992 Japan .

*Primary Examiner*—Upendra Roy
*Assistant Examiner*—Sean Vincent
*Attorney, Agent, or Firm*—Ostrolenk, Faber, Gerb & Soffen

[57] ABSTRACT

A copper alloy contains beryillium ranging from 0.2 to 0.7% in weight, nickel ranging from 0.1% to 2% in weight, and the balance copper and incidental impurities. Preferably, the incidental impurities include sulfur. A first preferable additional substance includes cobalt, zirconium or iron. A second preferable substance includes tin or zinc. A lead frame with a fine lead pattern is formed from a sheet of the copper alloy without burr, thereby improving the production yield of the lead frame.

6 Claims, 2 Drawing Sheets

COPPER ALLOY FOR FINE PATTERN LEAD FRAME

FIELD OF THE INVENTION

This invention relates to a lead frame and, more particularly, to copper alloy for a fine pattern lead frame used for a semiconductor integrated circuit package.

DESCRIPTION OF THE RELATED ART

The rapid development of semiconductor integrated circuit devices leads to semiconductor chips with higher input/output count, and creates challenges to packaging technologies. Various packaging technologies have been developed, and a ceramic package, a refractory package, a glass-sealed package and a plastic molding package are, by way of example, known to a person skilled in the art. The plastic molding package is attractive because of low cost and high productivity.

According to the plastic mold packaging technology, a lead frame is formed from a metal plate through an etching or a pressing, and semiconductor chips are mounted on the lead frame. The semiconductor chips are electrically connected with sets of leads of the lead frame, and are, thereafter, sealed in plastic packages through a molding process. The sets of leads are separated from the frame, and are bent for mounting on a printed circuit board.

In order to provide electrical connections between the printed circuit board and a state-of-the-art semiconductor integrated circuit with a higher input/output count, the lead frame is expected to have a large number of leads; however, the recent tendency in the electronic field, i.e., the down-sizing does not allow packaging designers to enlarge semiconductor integrated circuit devices. Therefore, a lead frame with a fine lead-pattern is required for the state-of-the-art semiconductor integrated circuit.

Various technical problems rise against a packaging designer, and one of the technical problems is mechanical strength of thin leads. Another problem is electric conductivity. If the mechanical strength is insufficient, the thin leads are liable to bend and break during the assembling work on a printed circuit board. Low conductive loads result in large time constant, and electric signals passing therethrough tend to be deformed.

As described hereinbefore, the lead frame is formed from a metal plate, and one of the approaches to overcome the problem is to develop a strong and highly conductive alloy.

Japanese Publication (Kokoku) No. 4-53936 discloses a copper alloy containing beryllium ranging from 0.21 to 0.28 percent in weight and nickel ranging from 0.5 to 1.3 percent in weight. According to the experimental result disclosed in the Japanese Publication, the copper alloy achieved the tensile strength ranging from 58 to 66 kgf/mm$^2$ and the conductivity ranging from 66 to 68% IACS (International Annealed Copper Standard).

The copper alloy disclosed in the Japanese Publication targeted the tensile strength and the conductivity for application to 256 K-bit large scale integrations, and a problem is encountered in a lead frame for the state-of-the-art semiconductor integrated circuit devices in that a fine pitch is hardly formed at a high production yield.

SUMMARY OF THE INVENTION

It is therefore an important object of the present invention to provide a copper alloy which is available for a lead frame used in a state-of-the-art semiconductor integrated circuit device.

To accomplish the object, the present invention proposes to add either magnesium or manganese.

In accordance with one aspect of the present invention, there is provided a copper alloy used for a lead frame composed of beryllium ranging from 0.2 percent to 0.7 percent in weight, nickel ranging from 1.0 percent to 5.0 percent in weight, at least one substance selected from the group consisting of manganese and magnesium, and ranging from 0.01 percent to 2.0 percent in weight, copper, and incidental impurities containing sulfur.

The copper alloy may contain both or either of the magnesium and the manganese.

In accordance with another aspect of the present invention, there is provided a copper alloy used for a lead frame composed of beryllium ranging from 0.2 percent to 0.7 percent in weight, nickel ranging from 1.0 percent to 5.0 percent in weight, at least one substance selected from the group consisting of tin ranging from 0.05 percent to 2.0 percent in weight and zinc ranging from 0.05 percent to 2.0 percent in weight, at least one second substance selected from the group consisting of manganese and magnesium, and ranging from 0.01 percent to 2.0 percent in weight, the total weight percentage of the first substance and the second substance ranging from 0.01 percent to 3.0 percent, copper, and incidental impurities containing sulfur.

The copper alloy may contain both or either of the magnesium and the manganese.

In accordance with yet another aspect of the present invention, there is provided a copper alloy used for a lead frame composed of beryllium ranging from 0.2 percent to 0.7 percent in weight, nickel ranging from 1.0 percent to 5.0 percent in weight, a substance selected from the group consisting of cobalt ranging from 0.01 percent to 5.0 percent in weight, zirconium ranging from 0.01 percent to 1.0 percent in weight and iron ranging from 0.01 percent to 1.0 percent in weight, copper and, incidental impurities containing sulfur.

More than one substance selected from the group consisting of cobalt, zirconium and iron may be contained in the copper alloy.

BRIEF DESCRIPTION OF THE DRAWINGS

The features and advantages of the copper alloy according to the present invention will be more clearly understood from the following description taken in conjunction with the accompanying drawings in which.

DESCRIPTION OF THE PREFERRED EMBODIMENTS

First Embodiment

Figure 1:
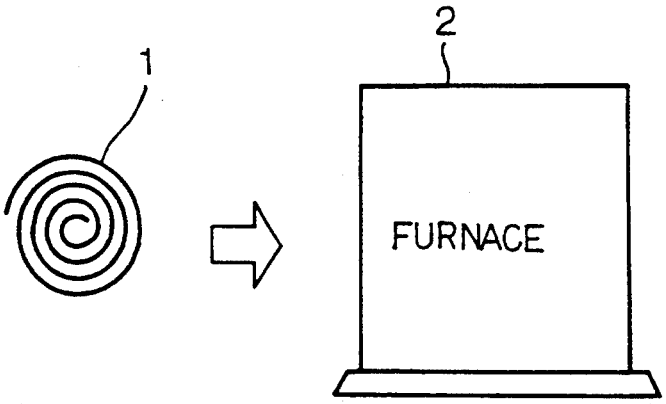
FIG. 1 is a view showing a heat treatment stage of a post-treatment according to the present invention.

Copper, beryllium, nickel, magnesium and manganese are prepared for the first embodiment. The magnesium is mixed with the copper, the beryllium and the nickel at predetermined compositions, and the manganese is also mixed with the copper, the beryllium and the nickel at predetermined compositions.

The mixtures are melted in vacuum ambience in argon-contained ambience at 80 torr, and ingots are produced from the respective mixtures.

The ingots are maintained at 880 degrees in centigrade for four hours, and a hot forging is carried out on the ingots.

The hot forgings are heated at 900 degrees in centigrade for two hours, and are, thereafter, subjected to a hot rolling.

A cold rolling at 80 percent, a solution heat treatment at 940 degrees in centigrade and an anneal at 30° C. per second are repeated, and the cold rolling is completed at 30 percent.

Rolled plates thus obtained are subjected to an aging treatment, and are 0.125 millimeters in thickness. Lead frame are patterned from the rolled plates through a cold working.

The ingots, and, accordingly, rolled plates implementing the first embodiment contain beryllium ranging from 0.2 percent to 0.7 percent in weight, nickel ranging from 1.0 percent to 5.0 percent in weight and at least one of the manganese and the magnesium ranging from 0.01 percent to 2.0 percent in weight. The proportion of beryllium atoms to nickel atoms is regulated to 0.9 to 1.2. If the proportion of beryllium atoms is less than 0.9, nickel grains are precipitated in the matrix, and the rolled plate suffers from poor smoothness, bad pattern transfer through an etching process and non-uniform plating. On the other hand, if the proportion of beryllium is greater than 1.2, the machinability is not accepted.

Only magnesium or manganese is contained in an ingot implementing the first embodiment, and the content of magnesium or manganese is fallen into the above described range. On the other hand, another ingot contains both magnesium and manganese, and the total weight percentage also ranges from 0.01 to 2.0.

If the beryllium is less than 0.2 percent in weight, the rolled plate is too small in tensile strength to form a lead frame for a state-in-the-art semiconductor integrated circuit device at a high yield. On the other hand, if the beryllium is greater than 0.7 percent in weight, the tensile strength is not increased, and the rolled plate is uneconomical.

If the nickel is less than 1.0 percent in weight, the tensile strength is too small to form a lead frame at a high yield. On the other hand, if the nickel is greater than 5.0 percent in weight, the conductivity of the rolled plate is not large enough to propagate an electric signal without deform.

If the magnesium, the manganese or both elements is less than 0.01 percent in weight, burr takes place during a cold working for patterning into a fine pitch lead frame, and an additional work for removing the burr is liable to break the leads. Therefore, the content less than 0.01 percent in weight is undesirable for the production yield. On the other hand, if the magnesium, the manganese or both elements is greater than 2.0 percent in weight, the molten alloy does not smoothly flow in the forging stage, and the conductivity is lowered.

The beryllium and nickel keep the rolled plates mechanically strong and electrically conductive, and the magnesium and/or the manganese improves the machinability of the rolled plates. Therefore, the copper alloys implementing the first embodiment are available for lead frames with a fine lead pattern. Namely, lead frames are formed from the rolled plates implementing the first embodiment through a cold working such as a press working, and only small burr takes place in the leads with a fine pattern. This is because of the fact that manganese and/or magnesium decrease sulfur in the crystal matrix through reaction to form magnesium sulfide and/or manganese sulfide. The burr is removed from the lead frames through a light trimming work, and the leads are hardly bent or broken, because small sharing force is merely applied to the burr. This results in a high production yield. A lead frames with a fine lead pattern is also formed through a hot working, and the magnesium and/or the manganese allows the hot working to realize the fine lead pattern through the decrease of sulfur.

Second Embodiment

Copper, beryllium, nickel, tin, zinc, magnesium and manganese are prepared for the second embodiment. The magnesium is mixed with the copper, the beryllium, the nickel and either or both of tin and zinc at predetermined compositions, and the manganese is also mixed with the copper, the beryllium, the nickel and either or both of tin and zinc at predetermined compositions.

Rolled plates of different compositions are made from the mixtures as similar to those of the first embodiment.

Namely, the mixtures are melted in vacuum ambience in argon-contained ambience at 80 torr, and ingots are produced from the respective mixtures.

The ingots are maintained at 880 degrees in centigrade for four hours, and a hot forging is carried out on the ingots.

The hot forgings are heated at 900 degrees in centigrade for two hours, and are, thereafter, subjected to a hot rolling.

A cold rolling at 80 percent, a solution heat treatment at 940 degrees in centigrade and an anneal at 30° C. per second are repeated, and the cold rolling is completed at 30 percent.

The rolled plates thus obtained are subjected to an aging treatment, and are 0.125 millimeters in thickness. Lead frame are patterned from the rolled plates through a cold working.

The ingots, and, accordingly, rolled plates implementing the second embodiment contain beryllium ranging from 0.2 percent to 0.7 percent in weight, nickel ranging from 1.0 percent to 5.0 percent in weight, at least one of the tin and zinc ranging from 0.01 percent to 2.0 percent in weight and at least one of the manganese and the magnesium ranging from 0.01 percent to 2.0 percent in weight. The proportion of beryllium atoms to nickel atoms is regulated to 0.9 to 1.2, and the total weight percentage of the tin, the zinc, the magnesium and the manganese ranges from 0.01 percent to 3.0 percent in weight.

The reasons for the beryllium content, the nickel content, the magnesium and/or manganese content and the proportion of beryllium to nickel are similar to those of the first embodiment, and are not repeated for avoiding repetition.

The tin and/or the zinc improves the durability after soldering on the lead frame produced from the copper alloys implementing the second embodiment. However, if the tin and/or the zinc is less than 0.01 percent in weight, the soldered lead frames are liable to be peel due to age deterioration. On the other hand, if the tin and/or zinc is greater than 3.0 percent in weight, the electrical conductivity of the rolled plates is not large enough to used in the lead frame for state-of-the-art semiconductor integrated circuit devices.

Thus, the copper alloys implementing the second embodiment achieves high reliability as well as all the advantages of the copper alloys implementing the first embodiment.

Third Embodiment

Copper, beryllium, nickel, manganese, magnesium, tin, zinc, cobalt, zirconium and iron are prepared for the third embodiment. The cobalt, the zirconium, the iron and combinations thereof are mixed with the copper, the beryllium and the nickel at predetermined compositions for producing a plurality of mixtures, and the magnesium and/or manganese are further mixed into first predetermined mixtures selected from the plurality of mixtures. Moreover, the tin and/or zinc are mixed into second predetermined mixtures selected from the remaining mixtures, and are further mixed into third predetermined mixtures selected from the first predetermined mixtures. As a result, the plurality of mixtures are broken down into four groups, i.e., mixtures, which is hereinbelow referred to as "first mixture group", containing the copper, the beryllium, the nickel and at least one of the cobalt, the zirconium and the iron, the first predetermined mixtures, which is hereinbelow referred to as "second mixture group", containing the copper, the beryllium, the nickel and at least one of the magnesium and the manganese, the second mixtures, which is hereinbelow referred to as "third mixture group", containing the copper, the beryllium, the nickel, at least one of the cobalt, the zirconium and the iron and at least one of the tin and the zinc, and the third mixtures, which is hereinbelow referred to as "fourth mixture group", containing the copper, the beryllium, the nickel, at least one of the cobalt, the zirconium and the iron, at least one of the manganese and the magnesium and at least one of the tin and the zinc.

The mixtures are melted in vacuum ambience in argon-contained ambience at 80 torr, and ingots are produced from the respective mixtures.

The ingots are maintained at 880 degrees in centigrade for four hours, and a hot forging is carried out on the ingots.

The hot forgings are heated at 900 degrees in centigrade for two hours, and are, thereafter, subjected to a hot rolling.

A cold rolling at 80 percent, a solution heat treatment at 940 degrees in centigrade and an anneal at 30° C. per second are repeated, and the cold rolling is completed at 30 percent.

Rolled plates thus obtained are subjected to an aging treatment, and are 0.125 millimeters in thickness. Lead frame are patterned from the rolled plates through a cold working.

Each of the rolled plates produced from the first mixture group is composed of beryllium ranging from 0.2 percent to 0.7 percent in weight, nickel ranging from 1.0 percent to 5.0 percent in weight, one or more than one substances selected from the group consisting of cobalt ranging from 0.01 percent to 5.0 percent in weight, zirconium ranging from 0.01 percent to 1.0 percent in weight and iron ranging from 0.01 percent to 1.0 percent in weight.

Each of the rolled plates produced from the second mixture group is composed of beryllium ranging from 0.2 percent to 0.7 percent in weight, nickel ranging from 1.0 percent to 5.0 percent in weight, one or more than one substances selected from the group consisting of cobalt ranging from 0.01 percent to 5.0 percent in weight, zirconium ranging from 0.01 percent to 1.0 percent in weight and iron ranging from 0.01 percent to 1.0 percent in weight, and one or more than one substances selected from the group consisting of tin ranging from 0.05 percent to 2.0 percent in weight and zinc ranging from 0.05 percent to 2.0 percent in weight.

Each of the rolled plated produced from the third mixture group is composed of beryllium ranging from 0.2 percent to 0.7 percent in weight, nickel ranging from 1.0 percent to 5.0 percent in weight, one or more than one substances selected from the group consisting of cobalt ranging from 0.01 percent to 5.0 percent in weight, zirconium ranging from 0.01 percent to 1.0 percent weight and iron ranging from 0.01 percent to 1.0 percent in weight, and one of more than one substances selected from the group consisting of manganese ranging from 0.01 percent to 2.0 percent in weight and magnesium ranging from 0.01 percent to 2.0 percent in weight, and a substantial part of the manganese and/or the magnesium is contained in the form of manganese sulfide and/or magnesium sulfide.

Each of the rolled plates produced from the fourth mixture group is composed of beryllium ranging from 0.2 percent to 0.7 percent in weight, nickel ranging from 1.0 percent to 5.0 percent in weight, one or more than one substances selected from the group consisting of cobalt ranging from 0.01 percent to 5.0 percent in weight, zirconium ranging from 0.01 percent to 1.0 percent in weight and iron ranging from 0.01 percent to 1.0 percent in weight, one or more than one first substances selected from the group consisting of manganese ranging from 0.01 percent to 2.0 percent in weight and magnesium ranging from 0.01 percent to 2.0 percent in weight and one or more than one second substances selected from the group consisting of tin ranging from 0.05 percent to 2.0 percent in weight and zinc ranging from 0.05 percent to 2.0 percent in weight, and the total weight percentage of the first substance or first substances and the second substance or second substances ranges from 0.01 percent to 3.0 percent, and a substantial part of the manganese and/or the magnesium is contained in the form of manganese sulfide and/or magnesium sulfide.

When lead frames are formed from the rolled plates produced from the first mixture group through a lithographic process, lead frame patterns are exactly transferred to the rolled plates, and the surfaces are smooth, because the cobalt, zirconium and iron miniaturized the grains. However, if the content of the cobalt, the zirconium or the iron is less than the above described range, the grains are hardly miniaturized, and the lead frame pattern is liable to be deviated. On the other hand, the content exceeds over the above described range, the electrical conductivity is deteriorated.

The rolled plates produced from the second mixture group are further improved in durability after soldering by virtue of at least one of the tin and the zinc, and the rolled plates produced from the third mixture group are further improved in machinability by virtue of at least one of the magnesium and the manganese. The reasons for the contents of the tin/zinc and the magnesium/- manganese are analogous to those of the first and second embodiments.

The rolled plates produced from the fourth mixture group achieve a good pattern transfer, a good durability and a good machinability. However, if the total weight percentage of tin/zinc and magnesium/manganese is less than 0.01, the resistance against aged deterioration is relatively low. On the other hand, if the total weight percentage is greater than 3.0, the electrical conductivity becomes too small.

As will be appreciated from the foregoing description, the copper alloys according to the present invention are available for a lead frame with a fine lead pattern by virtue of the magnesium and/or manganese contained therein, and the durability and the good pattern transfer through a lithographic process are further achieved by adding tin/zinc and cobalt/zirconium/iron thereto.

When the cobalt alloy according to the present invention contains more than one element selected from cobalt, zirconium, iron and nickel, the total weight percentage should be equal to or less than 5.0 percent because of the conductivity.

If beryllium/(cobalt+zirconium+iron+nickel) ratio in weight percent ranges from 0.9 to 1.2, the clearness is improved.

Examples

The present inventor produced metal strips from the rolled plates of the first, second and third embodiments, and the metal strips were 20 millimeters in width, 50 millimeters in length and 0.125 millimeter in thickness. The present inventor measured a tensile strength, a electrical conductivity and durability after soldering for the metal strips labeled as "specimens 1 to 29" in Tables 1 and 2, and further observed the mettarographic structures for evaluating clearness and machinability.

The durability was evaluated as follows. First, the metal strips were dipped into molten solder composed of tin at 60 percent and lead at 40 percent, and were, thereafter, exposed to the atmosphere at 150 degrees in centigrade for 1000 hours. After the exposure, the metal strips were bent at 90 degrees, and the bent portions were observed through a microscope.

The present inventor further evaluated the burr produced through a press working. In detail, a press working was repeated on each metal strip million times at 500 stroke per minute, and a clearance was regulated at 5 percent of the thickness of the metal strip. The height of burr was measured, and the ratio R was calculated as follows.

$R=\{(\text{height of burr})/(\text{thickness of metal strip})\}\times 100$ [%] If ratio R is small, the metal strip is suitable for a fine lead pattern at a high production yield, because the burr is easily removed by applying relatively small sharing force.

Table 1 shows the composition of each specimen, and the evaluation was summarized in Table 2.

TABLE 1

| Specimen | Compositions | | | |
|---|---|---|---|---|
| | Be | Ni | Co, Zr, Fe | Zn, Sn, Mg, Mn |
| 1 | 0.2 | 1.2 | | Zn: 0.05 |
| 2 | 0.5 | 3.0 | | Sn: 0.05 |
| 3 | 0.5 | 3.0 | | Zn: 2.0, Mg: 0.01 |
| 4 | 0.5 | 3.0 | | Zn: 0.5, Mn: 0.5 |
| 5 | 0.5 | 2.5 | Co: 0.5 | Zn: 1.0 |
| 6 | 0.5 | 1.0 | Co: 2.0 | Zn: 1.0 |
| 7 | 0.5 | 2.5 | Zr: 1.0 | Mn: 1.0 |

TABLE 1-continued

| Specimen | Compositions | | | |
|---|---|---|---|---|
| | Be | Ni | Co, Zr, Fe | Zn, Sn, Mg, Mn |
| 8 | 0.5 | 2.5 | Fe: 0.5 | Mg: 1.0 |
| 9 | 0.5 | 2.5 | Co: 0.5 | Mg: 0.5, Mn: 0.5 |
| 10 | 0.5 | 2.5 | Co: 0.5 | Sn: 1.0 |
| 11 | 0.7 | 5.0 | | Zn: 2.0 |
| 12 | 0.2 | 1.4 | | Mg: 0.05 |
| 13 | 0.5 | 2.8 | | Zn: 1.0 |
| 14 | 0.5 | 3.5 | | Zn: 1.0 |
| 15 | 0.6 | 4.0 | | Sn: 2.0 |
| 16 | 0.6 | 3.5 | | Mn: 2.0 |
| 17 | 0.2 | 1.2 | | Zn: 0.03 |
| 18 | 0.5 | 3.0 | | Sn: 0.03 |
| 19 | 0.5 | 5.0 | | Zn: 1.0 |
| 20 | 0.7 | 5.0 | | Mg: 0.005 |
| 21 | 0.5 | 3.0 | | Zn: 2.0, Sn: 2.0 |
| 22 | 0.5 | 3.0 | | Mn: 0.005 |
| 23 | 0.7 | 3.0 | | Zn: 1.0 |
| 24 | 0.2 | 1.0 | | Zn: 0.005 |
| 25 | 0.2 | 1.5 | | Zn: 0.05 |
| 26 | 0.7 | 3.0 | | Zn: 2.0 |
| 27 | 0.6 | 5.0 | | Zn: 2.0 |
| 28 | 0.5 | 2.5 | | Zn: 1.0 |
| 29 | 0.5 | 4.0 | | Zn: 1.0 |

TABLE 2

| Specimen | Properties | | | | | |
|---|---|---|---|---|---|---|
| | Strength kgf/mm2 | Conductivity IACS % | Clearness | Durability | Machinability | Ratio R |
| 1 | 77 | 56 | good | none | good | 10 |
| 2 | 83 | 52 | good | none | good | 9 |
| 3 | 84 | 47 | good | none | good | 4 |
| 4 | 82 | 48 | good | none | good | 3 |
| 5 | 84 | 48 | good | none | good | 9 |
| 6 | 83 | 46 | good | none | good | 8 |
| 7 | 85 | 47 | good | none | good | 3 |
| 8 | 84 | 48 | good | none | good | 3 |
| 9 | 84 | 51 | good | none | good | 3 |
| 10 | 85 | 52 | good | none | good | 8 |
| 11 | 89 | 44 | good | none | good | 7 |
| 12 | 79 | 54 | good | none | good | 5 |
| 13 | 81 | 51 | good | none | good | 7 |
| 14 | 83 | 45 | good | none | good | 7 |
| 15 | 88 | 45 | good | none | good | 7 |
| 16 | 87 | 46 | good | none | good | 3 |
| 17 | 76 | 57 | good | peel | good | 12 |
| 18 | 82 | 50 | good | peel | good | 10 |
| 19 | 84 | 40 | bad | none | good | 9 |
| 20 | 88 | 46 | good | peel | good | 7 |
| 21 | 86 | 38 | good | none | good | 9 |
| 22 | 63 | 49 | good | peel | good | 8 |
| 23 | 84 | 42 | good | none | bad | 8 |
| 24 | 74 | 57 | good | none | bad | 10 |
| 25 | 78 | 53 | bad | none | good | 10 |
| 26 | 87 | 45 | good | none | bad | 9 |
| 27 | 89 | 40 | bad | none | good | 9 |
| 28 | 80 | 50 | good | none | bad | 9 |
| 29 | 85 | 46 | bad | none | good | 9 |

Specimens 12 and 16 are examples of the first embodiment, and ratios R are 5 and 3. Comparing ratios R of specimens 12 and 16 with ratios R of specimens 20 and 22, it is understood that the magnesium and the manganese fallen within the range according to the present invention surely decrease the burrs.

Specimens 3 and 4 are examples of the second embodiment. Comparing specimens 3 and 4 with specimens 1, 2, 11 and 13 to 15, the effect of magnesium and/or manganese is confirmed, and specimens 3 and 4 achieve the good durability as similar to specimens 1, 2, 11 and 13 to 15.

Specimens 5 to 10 are examples of the third embodiment, and teach that the magnesium and/or the manganese are effective against the burr.

Though not shown in Tables 2, the present inventor confirmed that a fine pattern was exactly transferred to copper alloys containing cobalt, zirconium or iron.

Post-Treatment for Copper Alloy

Each of the copper alloys according to the present invention is usually shaped into a coiled band plate, and the coiled band plate is delivered to a lead frame manufacturer. The coiled band plate is convenient for a transportation to the lead frame manufacturer. The lead frame manufacturer rewinds the coiled band plate, and produces lead frames from the band plate. In order to pattern the band plate into a fine pitch lead frame, the flatness is very important, and a post-treatment according to the present invention enhances the flatness by relieving internal stress of the coiled band plate.

Upon completion of realing a band plate of copper alloy according to the present invention in a coil, the coiled band plate 1 is subjected to a precipitation hardening in a furnace 2 as shown in FIG. 1. The heat-treating chamber of the furnace 2 creates nitrogen ambience at 350 degrees to 600 degrees in centigrade, and the coiled band plate 1 is maintained in the heat treating chamber for 2 to 10 hours. The furnace 2 is usually of the batch processing, because the batch processing effectively increases the hardness. However, a continuous furnace is available for a high throughput.

Figure 2:
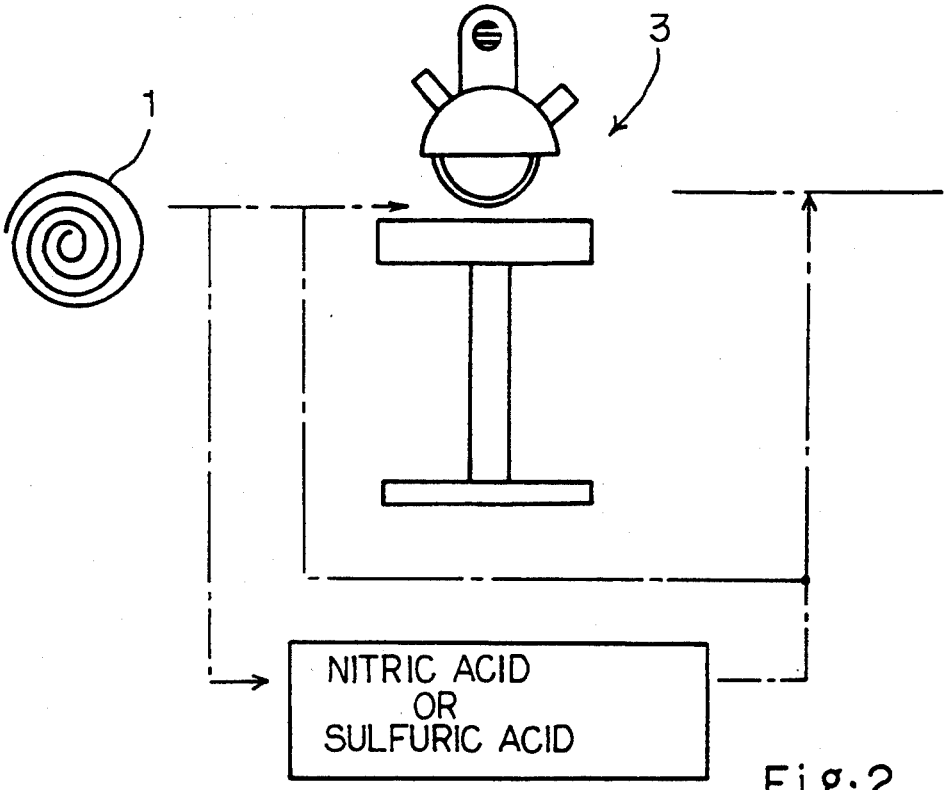
FIG. 2 is view showing a buffing/acid treating stage of the post-treatment according to the present invention.

While the coiled band plate 1 is being subjected to the precipitation hardening, it is impossible to perfectly present the coiled band plate 1 from oxidization. For this reason, the coiled band plate 1 is covered with thin natural oxide, and the natural oxide film is removed through a buffing, an acid treatment or the acid treatment followed by the buffing as shown in FIG. 2.

If the band plate is delivered after the removal of the natural oxide without any further treatment, distortion due to the precipitation hardening remains in the coiled band plate, and the removal of natural oxide roughens the surface of the band plate. For this reason, the lead frame manufacturer suffers from poor flatness and from a rough surface of the band plate due to the removal of the natural oxide.

Figure 3:
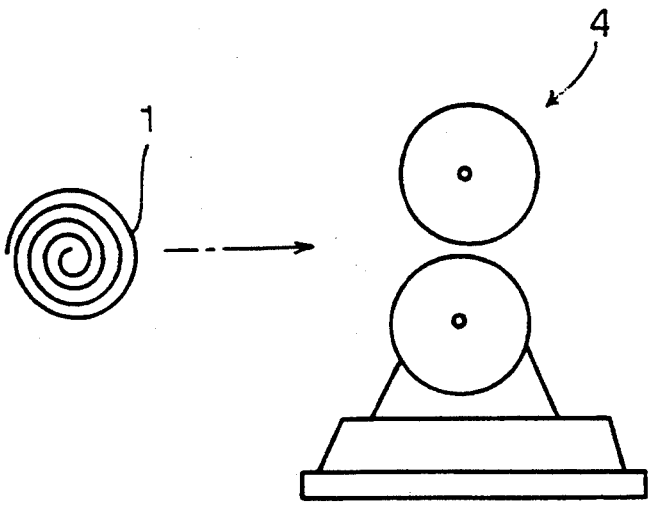
FIG. 3 is a view showing a leveling stage of the post-treatment according to the present invention.
Figure 4:
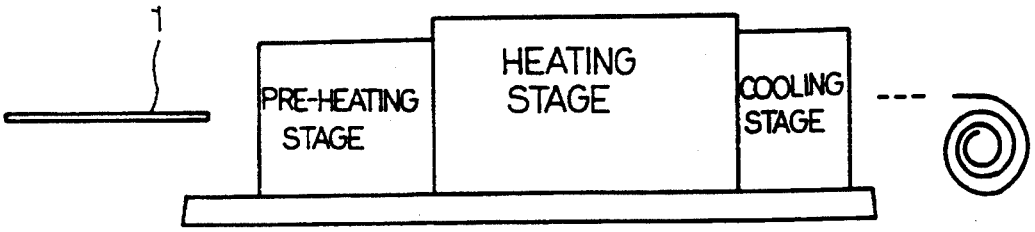
FIG. 4 is a view showing a stress relieving annealing state of the post-treatment according to the present invention.

For this reason, the post-treatment according to the present invention forcibly levels the band plate 1 by using a tension leveler or a roller leveler 4 as shown in FIG. 3. The band plate 1 may be rolled instead of the forcible leveling. While the band plate 1 is subjecting to the forcible leveling or the rolling, the surface thereof becomes flat and dense.

Finally, the band plate 1 is annealed for relieving from the strain, and the annealing is carried out at 300 degrees to 700 degrees in centigrade for 10 seconds to 1 minute. If the annealing is carried out below 300 degrees in centigrade, the strain remains in the band plate 1. On the other hand, if the temperature exceeds 700 degrees in centigrade, the precipitated grains are melted, and the hardness and the conductivity are lowered. A bright annealing may be applied to the band plate 1.

The band plate 1 thus treated is improved in surface conditions, and the flat and dense surface allows the band plate to pattern into a fine pitch. Moreover, even if the band plate is coiled again, the band plate is easily unwound without distortion.

The present inventor confirmed the advantages of the post-treatment. In detail, beryllium of 0.5 percent in weight, nickel of 3.0 percent in weight and zinc of 1.0 percent in weight were mixed with copper, and the mixture was melted in vacuum at 80 torr. The ingot thus obtained was subjected to a hot forging at 880 degrees in centigrade for 4 hours, and was, thereafter, hot rolled at 900 degrees in centigrade for 2 hours. The rolled plate was subjected to a cold working at 80 percent, and a solution heat treatment was carried out at 940 degrees in centigrade, then being cooled at 30° C./second. Band plates were produced through a cold working, and were annealed at 450 degrees in centigrade for 2 hours through a batch process. The annealed band plates were subjected to a buffing with No. 220 buff for removing natural oxide. The band plates were subsequently subjected to a leveling at different cold rolling rates CR, and were further annealed at different temperatures AT.

After the annealing, the annealed band plates were evaluated, and the results were summarized in Table 3, and ** represents a forcible leveling instead of the cold rolling.

In Table, 3, property A is internal stress (kgf/mm$^2$), property B is the number of bending motion at 90 degrees until break, property C is a gap between a surface of each band plate of 500 millimeters in length and a vertical surface, property D is a surface roughness (micron), property E is the tensile strength, and property F is the conductivity (% IACS).

TABLE 3

| | Treatment | | Properties | | | | | |
|---|---|---|---|---|---|---|---|---|
| Specimen | CR(%) | AT(°C.) | A | B | C | D | E | F |
| 1 | 70 | 600 | 3 | 3 | 1 | 0.5 | 95 | 45 |
| 2 | 50 | 600 | 2 | 4 | 3 | 0.6 | 90 | 45 |
| 3 | 50 | 400 | 3 | 4 | 5 | 0.6 | 92 | 47 |
| 4 | 30 | 400 | 2 | 5 | 7 | 0.8 | 88 | 47 |
| 5 | ** | 500 | 2 | 6 | 9 | 1.0 | 84 | 48 |
| 6 | — | — | 20 | 6 | 20 | 1.1 | 84 | 49 |
| 7 | 50 | 250 | 15 | 4 | 5 | 0.6 | 92 | 48 |
| 8 | 50 | 750 | 1 | 4 | 2 | 0.6 | 78 | 40 |
| 9 | 75 | 600 | 1 | 1 | 1 | 0.4 | 97 | 44 |

As will be understood from Table 3, specimens 1 to 5 are relieved from the internal stress without sacrifice of the mechanical strength by virtue of the post-treatment according to the present invention. However, large internal stress is left in specimens 5 and 6, because the annealing is not carried out or is carried out at low temperature. Specimens 7 and 8 are brittle due to annealing at high temperature, and are easily broken.

Although particular embodiments of the present invention have been shown and described, it will be obvious to those skilled in the art that various changes and modifications may be made without departing from the spirit and scope of the present invention.

What is claimed is:

1. A copper alloy used for a lead frame consisting of beryllium ranging from 0.2 percent to 0.7 percent in weight, nickel ranging from 1.0 percent to 5.0 percent in weight, the proportion of beryllium atoms to nickel atoms being regulated to a range from 0.9 to 1.2 manganese ranging from 0.01 percent to 2.0 percent in weight, and the balance copper and incidental impurities containing sulfur.

2. A copper alloy used for a lead frame consisting of beryllium ranging from 0.2 percent to 0.7 percent in weight, nickel ranging from 1.0 percent to 5.0 percent in weight, the proportion of beryllium atoms to nickel atoms being regulated to a range from 0.9 to 1.2, at least one substance selected from the group consisting of tin ranging from 0.05 percent to 2.0 percent in weight and zinc ranging from 0.05 percent to 2.0 percent in weight, manganese ranging from 0.01 percent to 2.0 percent in weight, the total weight percentage of said at least one substance and said manganese ranging from 0.06 percent to 3.0 percent, and the balance copper and incidental impurities containing sulfur.

3. A copper alloy used for a lead frame consisting of beryllium ranging from 0.2 percent to 0.7 percent in weight, nickel ranging from 1.0 percent to 5.0 percent in weight, the proportion of beryllium atoms in weight percentage to the total of nickel atoms, cobalt atoms, zirconium atoms and iron atoms in weight percentage being regulated to a range from 0.9 to 1.2, manganese ranging from 0.01 percent to 2.0 percent in weight, one substance selected from the group consisting of cobalt ranging from 0.01 percent to 5.0 percent in weight, zirconium ranging from 0.01 percent to 1.0 percent in weight and iron ranging from 0.01 percent to 1.0 percent in weight, and the balance copper and incidental impurities.

4. The copper alloy as set forth in claim 3, in which said incidental impurities contain sulfur.

5. The copper alloy as set forth in claim 3, in which further contains at least one of tin ranging from 0.05 percent to 2.0 percent in weight and zinc ranging from 0.05 percent to 2.0 percent in weight.

6. The copper alloy as set forth in claim 3, which further contains manganese ranging from 0.01 percent to 2.0 percent in weight, and at least one substance selected from the group consisting of tin ranging from 0.05 percent to 2.0 percent in weight and zinc ranging from 0.05 percent to 2.0 percent in weight, the total weight percentage of said manganese and said one substance selected from the group consisting of tin and zinc ranging from 0.06 percent to 3.0 percent and said incidental impurities contain sulfur.

* * * * *